US008876016B2

(12) United States Patent
Lai

(10) Patent No.: US 8,876,016 B2
(45) Date of Patent: Nov. 4, 2014

(54) WATER DISPENSER OF DRINKING FOUNTAIN

(75) Inventor: Cheng-Cheng Lai, Changhua (TW)

(73) Assignee: Yea Leng Drinking Foutain Co. Ltd., Changhua (TW)

( * ) Notice: Subject to any disclaimer, the term of this patent is extended or adjusted under 35 U.S.C. 154(b) by 367 days.

(21) Appl. No.: 13/336,966

(22) Filed: Dec. 23, 2011

(65) Prior Publication Data

US 2013/0161410 A1 Jun. 27, 2013

(51) Int. Cl.
*B05B 12/14* (2006.01)
*E03B 9/20* (2006.01)

(52) U.S. Cl.
USPC ..... 239/24; 239/29; 239/28

(58) Field of Classification Search
CPC ..... E03B 9/20; B05B 1/3006; B05B 1/323; B05B 1/14; F23D 14/10; A61L 9/127; A61L 9/12
USPC ..... 239/24–32, 566, 570; 62/389, 391
See application file for complete search history.

(56) References Cited

U.S. PATENT DOCUMENTS 2,645,885 A * 7/1953 Benua et al. ..... 137/505.38
3,921,903 A * 11/1975 Grimes et al. ..... 239/24
3,980,273 A * 9/1976 Turner et al. ..... 251/366
4,009,806 A * 3/1977 Dreibelbis et al. ..... 222/545
4,060,198 A * 11/1977 Dreibelbis et al. ..... 239/24
5,060,857 A * 10/1991 Engelbach ..... 239/32

* cited by examiner

*Primary Examiner* — Len Tran
*Assistant Examiner* — Thomas Berez
(74) *Attorney, Agent, or Firm* — Che-Yang Chen; Law Office of Michael Chen

(57) ABSTRACT

A water dispenser of a drinking fountain includes a water dispenser, an inner block and a control valve. The water dispenser has a receiving space to receive the plastic inner block made. A water channel and water inlet are recessedly formed on both ends of the inner block, wherein the water channel is corresponding to the water outlet of the water dispenser, and two engaging holes are spacedly formed on one side of the water channel and water inlet. The engaging holes are corresponding to connecting holes of the water dispenser. The major tubing inside the water dispenser is composed of a plastic inner block, the contact area between the water flow and the metal surface of the water dispenser is reduced so as to avoid accumulation of harmful heavy metal in the water when the water is flowing or stored, to achieve the goal of providing safe drinking water.

7 Claims, 5 Drawing Sheets

WATER DISPENSER OF DRINKING FOUNTAIN

FIELD OF THE INVENTION

The present invention relates to a water dispenser of a drinking fountain, and more particularly to a main inner tubing structure in the water dispenser that is made of a plastic inner block, so that contact area between the water flow and metal surface area in the water dispenser is reduced to avoid harmful heavy metal accumulated in the water flow to achieve the goal of providing safe drinking water.

BACKGROUND OF THE INVENTION

A conventional structure of a water dispenser of a drinking fountain includes a dispenser (40) and a valve body (50). A water channel (41) is located at a upper and lower portion of the dispenser (40), and an inlet end (42) is connected to a water source. A valve slot (43) is recessedly formed at one side of the dispenser (40), and two connecting holes (431) are formed at an opening surface of the valve slot (43). The connecting holes (431) are connected with the water channel (41) and the inlet end (42). The valve body (50) is disposed at the valve slot (43) of the dispenser (40), and a lower portion of the valve body (50) protrudingly has two connecting tubes (51) plugged in the connecting holes (431) of the dispenser (40). A press button (52) is protrudingly formed at an upper portion of the valve body (50) to switch one connecting tube with the other. When a user presses the press button (52), the two connecting tubes (51) are connected so that the drinking water flows from the inlet end (42) to the water channel (41) to achieve the goal of providing drinking water.

The conventional water dispenser structure is disadvantageous because the dispenser (40) is made by copper with additional lead for processing and molding, so when the drinking water flows through or stores in the inner tubing of the dispenser (40), it is likely to absorb the lead in the tubing to generate adverse effect on the human body. Also, since it is made mostly of copper, the entire structure may be too heavy. Meanwhile, the cost to manufacture the structure is hard to reduce, as well as the sales price, because the structure uses too much copper.

SUMMARY OF THE INVENTION

The problem to be solved in the present invention is (a) the dispenser is made by copper with additional lead for processing and molding, so when the drinking water flows through or stores in the inner tubing of the dispenser, it is likely to absorb the lead in the tubing to generate adverse effects on the human body; and (b) since it is made mostly of copper, the entire structure may be too heavy. Meanwhile, the cost to manufacture the structure is hard to reduce, as well as the sales price, because the structure uses too much copper.

The technical point to solve the problem is to provide a water dispenser of a drinking fountain includes a water dispenser, an inner block and a control valve. The water dispenser has a receiving space recessedly formed at a lower portion, and the receiving space has a water outlet at an opening surface. A valve slot is recessedly formed at one side of the water dispenser, and two connecting holes connecting to the receiving space are formed on an open surface of the valve slot. The inner block is made by plastic materials and located in the receiving space of the water dispenser, and a water channel and a water inlet are recessedly formed on both ends of the inner block, wherein the water channel is corresponding to the water outlet of the water dispenser, and the two engaging holes corresponding to the connecting holes of the water dispenser are spacedly formed at one side of the water channel and water inlet. The control valve is disposed at the valve slot of the water dispenser, and two connecting tubes are protrudingly and spacedly formed at a lower portion of the control valve, and the connecting tubes are plugged into the through hole. A press button is protrudingly formed on top of the control valve to switch between two connecting tubes, so that a water dispenser of a drinking fountain is obtained.

Comparing to conventional arts stated above: (a) the major tubing structure inside the water dispenser is composed of a plastic inner block, the contact area between the water flow and the metal surface of the water dispenser is reduced so as to avoid accumulation of harmful heavy metal in the water when the water is flowing or stored, and further achieve the goal of providing safe drinking water; and (b) the inner tubing structure of the water dispenser is composed of the inner block that is made by light materials such as plastic, reducing the total weight of the water dispenser. The cost of the materials is reduced as well, so the goals of providing a lightweight and cost effective structure is achieved.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
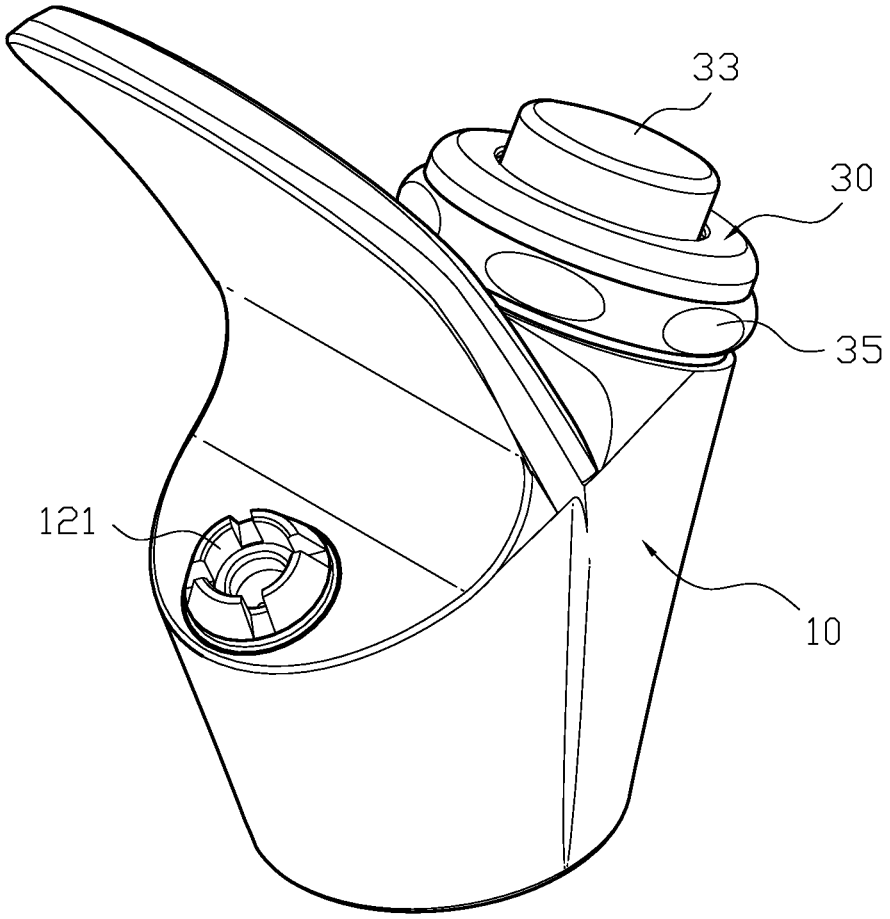
FIG. 1 illustrates a three-dimensional assembled view in the present invention.
Figure 2:
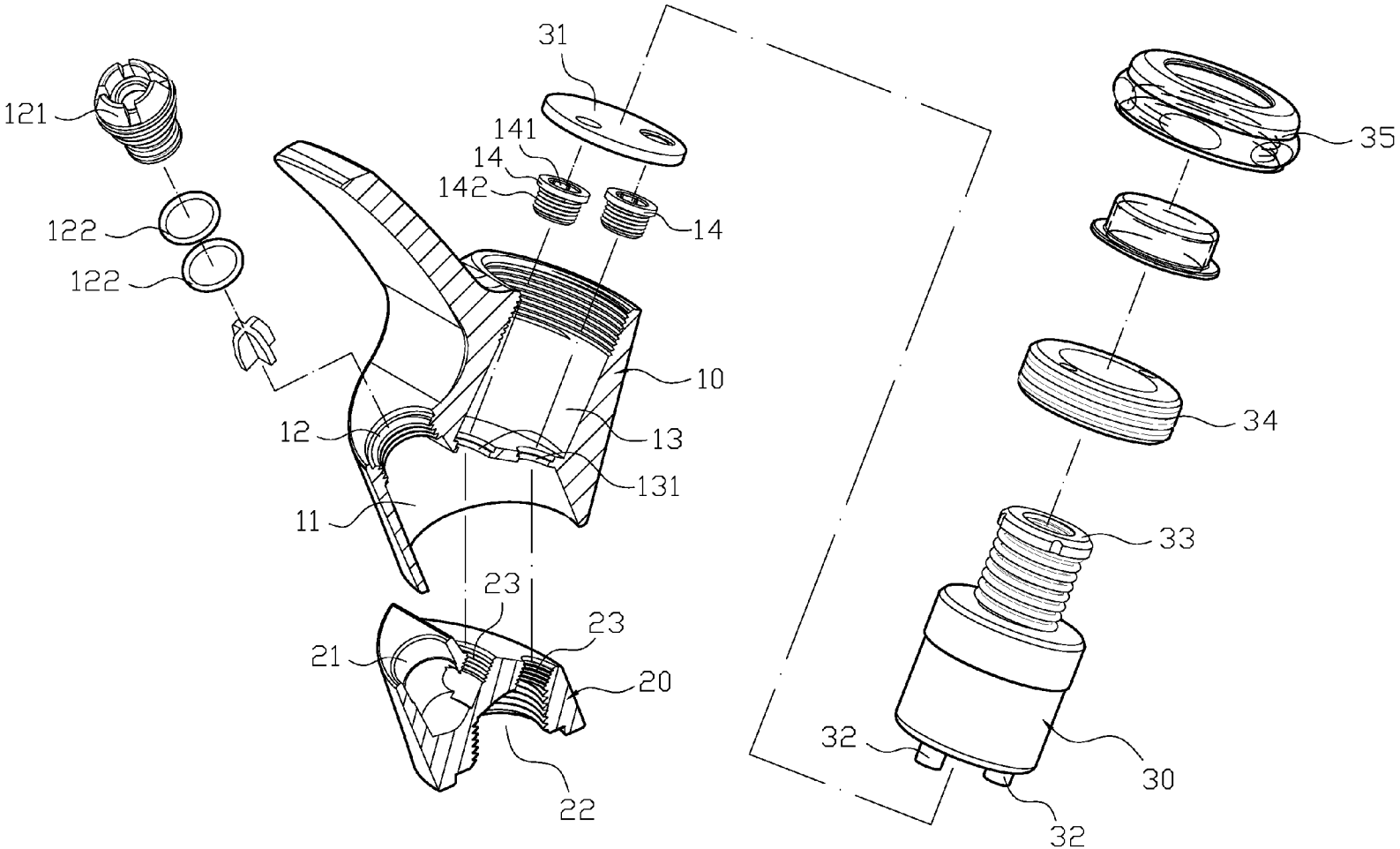
FIG. 2 illustrates a three-dimensional exploded view in the present invention.

In order to further understand the goal, characteristics and effect of the present invention, a number of embodiments along with the drawings are illustrated as following:

Referring to FIGS. 1 to 2, a water dispenser of a drinking fountain includes a water dispenser (10), an inner block (20) and a control valve (30). The water dispenser (10) has a receiving space (11) recessedly formed at a lower portion, and the receiving space (11) has a water outlet (12) at an opening surface. The water outlet (12) has a nozzle (121), which is made of non-metal materials (e.g. plastic), and a gasket (122) is formed at a periphery of the nozzle. A valve slot (13) is recessedly formed at one side of the water dispenser (10), and two connecting holes (131) connecting to the receiving space (11) are formed on an open surface of the valve slot (13). The valve slot (13) provides a connecting cover (14) that is made by non-metal materials (e.g. plastic), and has a non-circular through hole (141) for general tools to engage to achieve the goal of easy assembly and disassembly, and a lock section (142) is formed at an outer periphery of the connecting cover (14). The inner block (20) is made of plastic materials and located in the receiving space (11) of the water dispenser (10), and a water channel (21) and a water inlet (22) are recessedly formed on both ends of the inner block (20), wherein the water channel (21) corresponds to the water outlet (12) of the water dispenser (10), and the two engaging holes (23) are spacedly formed on the side of the water channel (21) and a water inlet (22). The engaging holes (23) are corresponding to the connecting holes (131) of the water dispenser (10), and the lock section (142) of the connecting cover (14) is locked to form a secure positioning. The control valve (30) is disposed at the valve slot (13) of the water dispenser (10) and a sealing unit (31) is disposed between opening surfaces of the valve slot (13). Two connecting tubes (32) are protrudingly and spacedly formed at a lower portion of the control valve (30), and the connecting tubes (30) are plugged into the through hole (141). A press button (33) is protrudingly formed on top of the control valve (30) to switch between two connecting tubes (32). A lock ring (34) is formed at a periphery of the press button (33), and one end of the lock ring (34) locks an opening edge of the valve slot (13) to secure the control valve (30) by pressing it, and the other end is provided for a cover (35) to lock.

Figure 3:
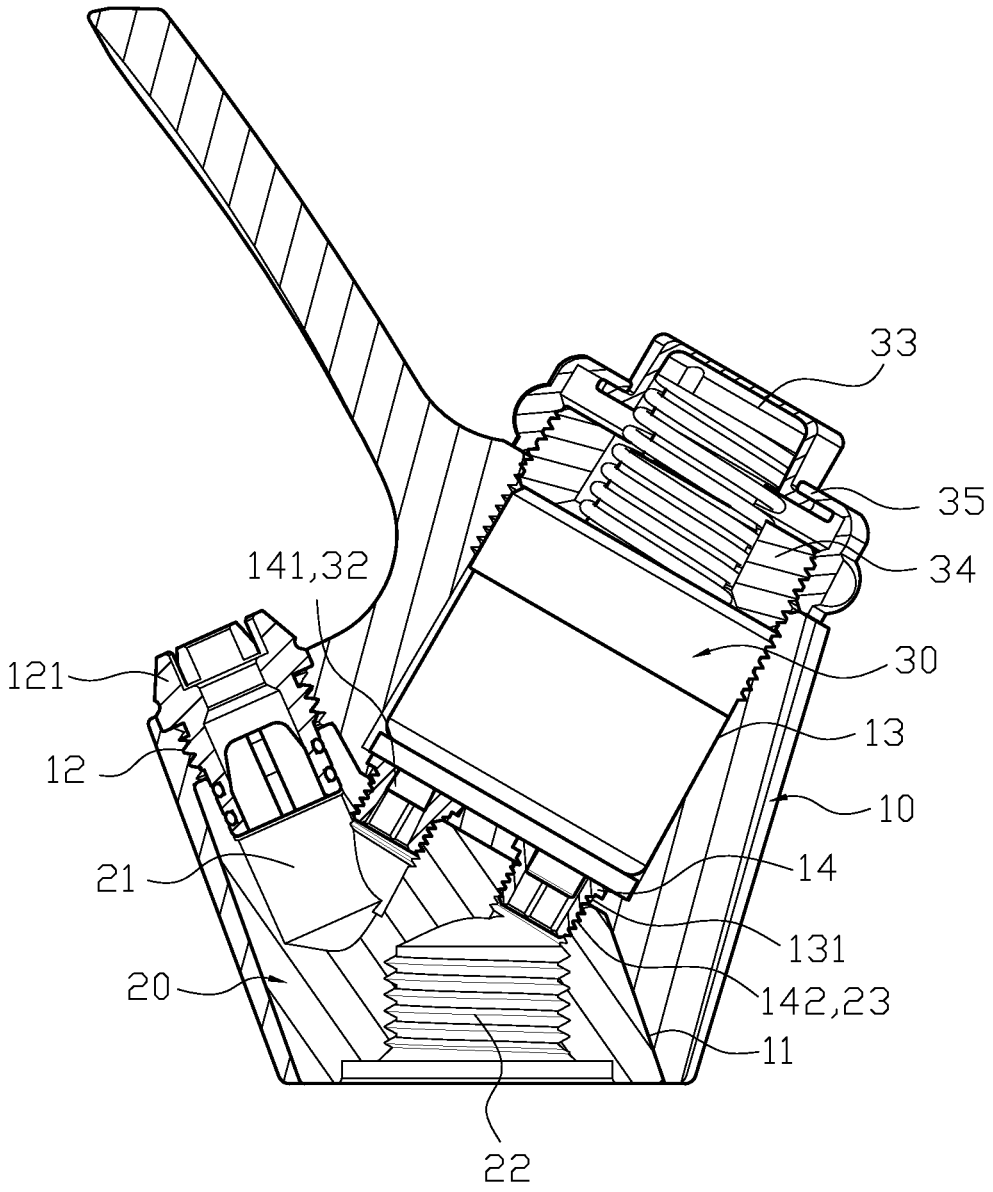
FIG. 3 illustrates a sectional schematic view in the present invention.

Referring to FIGS. 2 to 3 for the structure of the present invention, the inner block (20) is disposed in the receiving space (11) of the water dispenser (10), and the water channel (21) and the engaging holes (23) correspond to the water outlet (12) and the connecting holes (131). The connecting cover (14) passes through the connecting holes (131), and the lock section (142) locks the engaging holes (23) to form a secure positioning to complete the assembly of the inner block (20). Moreover, the control valve (30) is disposed into the valve slot (13) of the water dispenser (10), and the connecting tubes (32) are plugged into the through hole (141) of the connecting cover (14). One end of the lock ring (34) locks the opening edge of the valve slot (13) to form a secured positioning by pressing the control valve (30), while the other end is provided for a cover (35) to lock. The nozzle (121) then plugs into the water outlet (12) of the water dispenser (10) to finish the assembly process. Since the inner tubing structure of the water dispenser is composed of the inner block (20) made of light materials such as plastic, the total weight of the water dispense is reduced. The cost of the materials is reduced as well, so the goals of providing a lightweight and cost effective structure is achieved.

Figure 4:
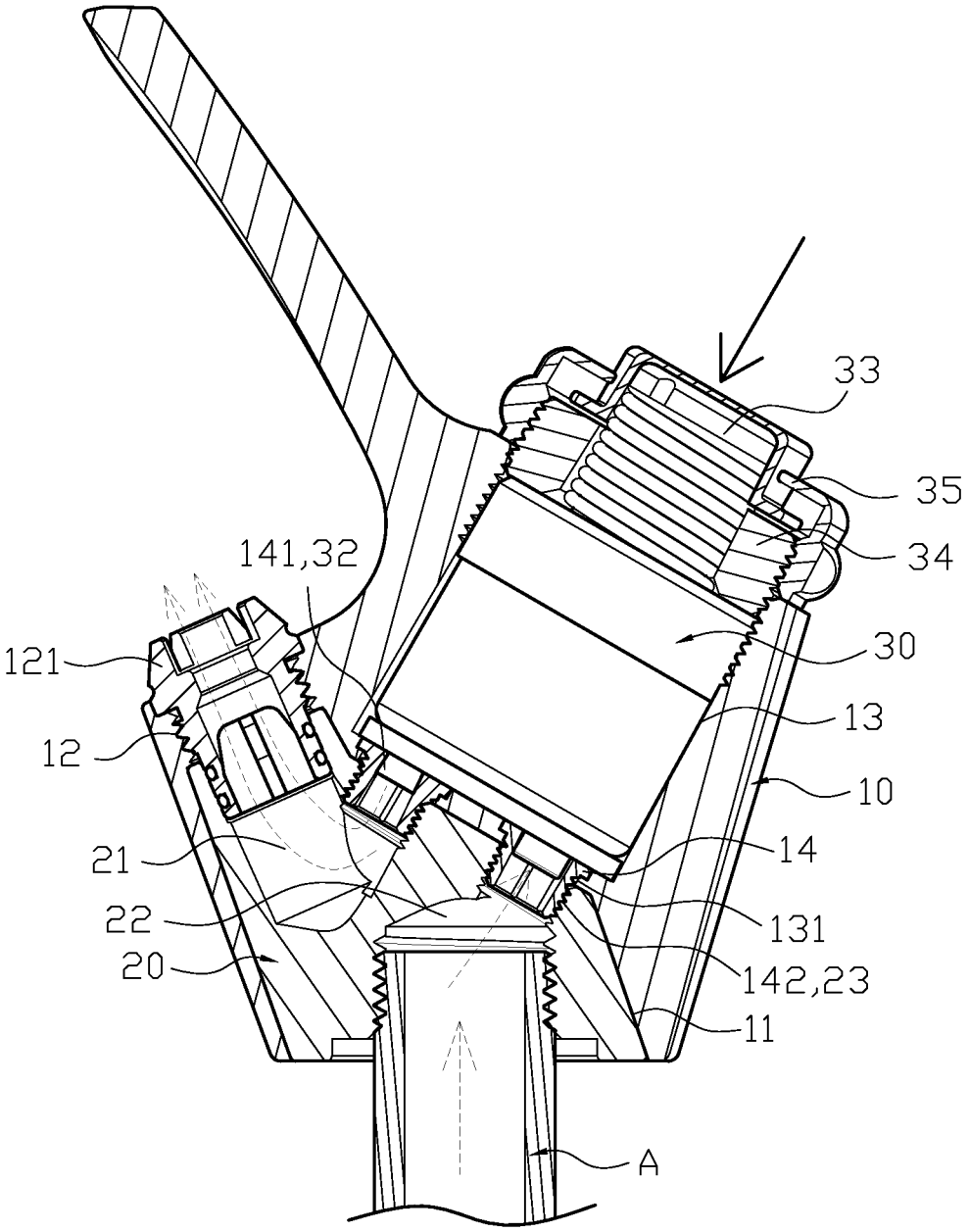
FIG. 4 illustrates a schematic view of the present invention when in use.
Figure 5:
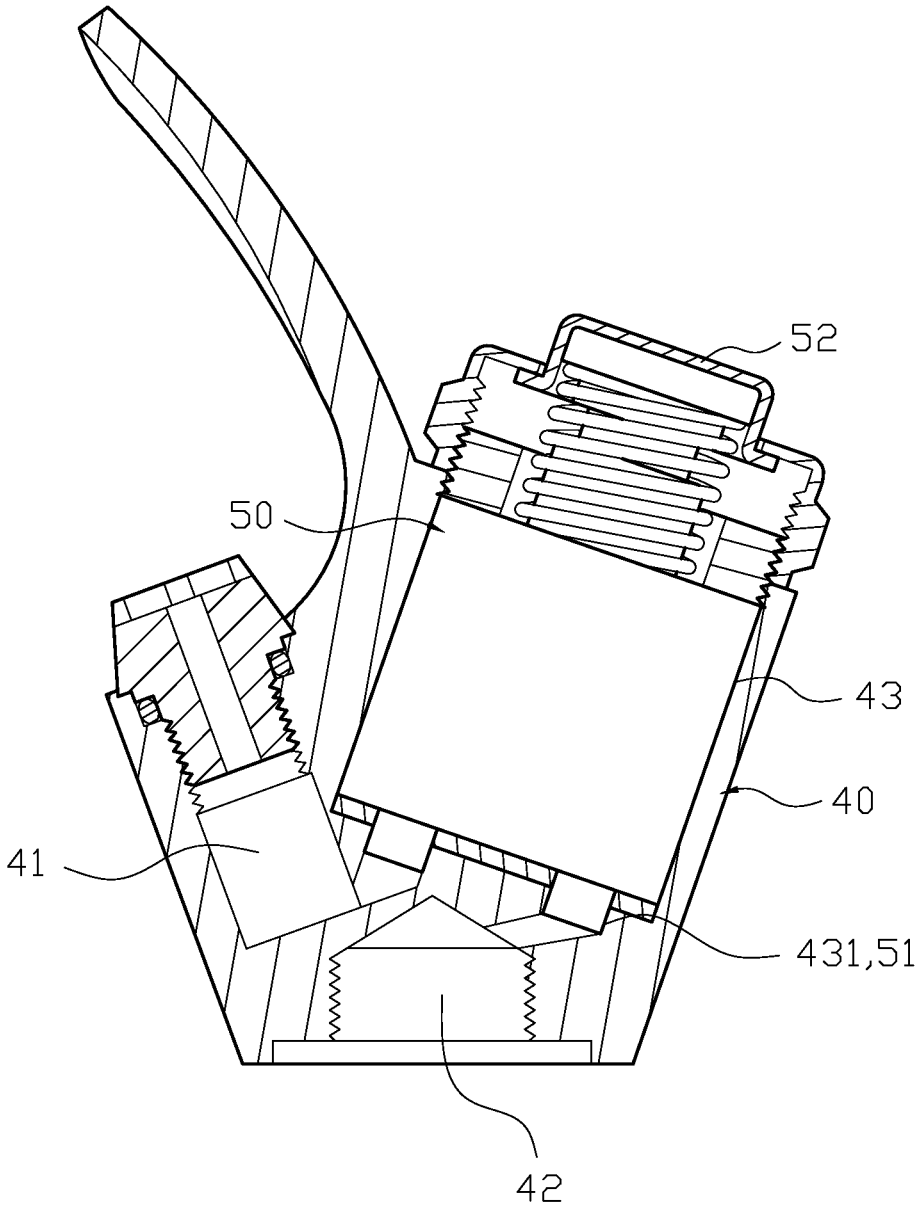
FIG. 5 PRIOR ART
FIG. 5 illustrates a sectional schematic view of prior art.

Referring to FIG. 4 for practical usage of the present invention, the water dispenser (10) is connected to a water source (A) through the water inlet (22) of the inner block (20). When the user presses the press button (33) of the control valve (30), the water flow passes through the connecting tubes of the connecting holes (131) in order, and flows to the nozzle (121) of the water outlet (12) to dispense the water. Since the major tubing structure inside the water dispenser (10) is composed of the plastic inner block (20), the contact area between the water flow and the metal surface of the water dispenser is reduced so as to avoid accumulation of harmful heavy metal in the water when the water is flowing or stored, and further achieve the goal of providing safe drinking water. Moreover, since the material of the connecting cover (14) and nozzle (121) is non-metallic as well, it again assures that the water does not contact the metal surface of the water dispenser (10) to provide safe drinking water.

According to the embodiment stated above, the present invention is advantageous because (a) the major tubing structure inside the water dispenser (10) is composed of plastic inner block (20), the contact area between the water flow and the metal surface of the water dispenser is reduced so as to avoid accumulation of harmful heavy metal in the water when the water is flowing or stored, and further achieving the goal of providing safe drinking water; and (b) the inner tubing structure of the water dispenser is composed of the inner block (20) that is made of light materials such as plastic, reducing the total weight of the water dispense is reduced. The cost of the materials is reduced as well, so the goal of providing a lightweight and cost effective structure is achieved.

Having described the invention by the description and illustrations above, it should be understood that these are exemplary of the invention and are not to be considered as limiting. Accordingly, the invention is not to be considered as limited by the foregoing description, but includes any equivalent.

What is claimed is:

1. A water dispenser of a drinking fountain comprising:

a water dispenser having a receiving space recessedly formed at a lower portion, the receiving space having a water outlet at an opening surface thereof, a valve slot recessedly formed at one side of the water dispenser, two connecting holes connecting to the receiving space formed on an open surface of the valve slot;

an inner block made by plastic materials and located in the receiving space of the water dispenser, and a water channel and a water inlet recessedly formed on both ends of the inner block, wherein the water channel is corresponding to the water outlet of the water dispenser, and two engaging holes corresponding to the connecting holes of the water dispenser are spacedly formed at one side of the water channel and water inlet; and a control valve disposed at the valve slot of the water dispenser, and two connecting tubes are protrudingly and spacedly formed at a lower portion of the control valve, and the connecting tubes are plugged into a through hole, wherein a press button is protrudingly formed on top of the control valve to switch between two connecting tubes, wherein the connecting hole of the water dispenser provides a connecting cover to connect the engaging holes to form a secure positioning, and the connecting cover has a non-circular through hole for the connecting tubes of the control valve to plug in.

2. The water dispenser of a drinking fountain of claim 1, wherein a nozzle is plugged in the water outlet of the water dispenser.

3. The water dispenser of a drinking fountain of claim 2, wherein the nozzle is made of non-metal materials.

4. The water dispenser of a drinking fountain of claim 2, wherein the nozzle is made of plastic.

5. The water dispenser of a drinking fountain of claim 1, wherein the connecting cover is made of non-metal materials.

6. The water dispenser of a drinking fountain of claim 1, wherein the connecting cover is made of plastic.

7. The water dispenser of a drinking fountain of claim 1, wherein the connecting cover locks the engaging holes of the inner block.

* * * * *